United States Patent [19]

Lake et al.

[11] 4,082,576

[45] Apr. 4, 1978

[54] ULTRA-HIGH STRENGTH LOW ALLOY TITANIUM BEARING FLAT ROLLED STEEL AND PROCESS FOR MAKING

[75] Inventors: Peter B. Lake; John J. Grenawalt; Ronald L. Pastorek, all of Boardman Township, Mahoning County, Ohio

[73] Assignee: Youngstown Sheet and Tube Company, Youngstown, Ohio

[21] Appl. No.: 729,614

[22] Filed: Oct. 4, 1976

[51] Int. Cl.[2] ..... C21D 1/80

[52] U.S. Cl. ..... 148/12 F; 148/12.3

[58] Field of Search ..... 148/12 F, 12.3

[56] References Cited

U.S. PATENT DOCUMENTS

| | | | |
|---|---|---|---|
| 3,264,144 | 8/1966 | Frazier et al. | 148/12.4 |
| 3,492,173 | 1/1970 | Goodenow | 148/12 C |
| 3,857,740 | 12/1974 | Gondo et al. | 148/12 F |
| 3,925,111 | 12/1975 | Takechi et al. | 148/12 F |
| 3,947,293 | 3/1976 | Takechi et al. | 148/12 F |
| 3,950,190 | 4/1976 | Lake | 148/12 F |

*Primary Examiner*—W. Stallard

*Attorney, Agent, or Firm*—John Stelmah

[57] ABSTRACT

A high strength low alloy titanium, cold reduced flat rolled steel product with yield strengths in excess of 120 and as high as at least 180 ksi and process for producing the same.

20 Claims, 11 Drawing Figures

ULTRA-HIGH STRENGTH LOW ALLOY TITANIUM BEARING FLAT ROLLED STEEL AND PROCESS FOR MAKING

BACKGROUND OF THE INVENTION

This invention relates to the production of titanium bearing aluminum-killed steel in cold rolled form having a yield strength in excess of 120 ksi and having good bendability and formability characteristics.

There exists an increased demand for lightweight high strength steels having good forming and weldability characteristics, particularly in the automotive industry where weight reduction is a desideratum.

DESCRIPTION OF PRIOR ART

In U.S. Pat. No. 3,625,780, Bosch et al, it is disclosed that a low-alloy high strength titanium bearing hot-strip steel product having a yield strength in the range of 60 to 120 ksi can be produced.

In U.S. Pat. No. 3,492,173, Goodenow, it is disclosed that recovery-annealed cold-worked titanium steels containing at least four times as much effective titanium as carbon are known to possess certain distinctive properties. It is there contended that such steels have generally higher tensile strengths, yield strengths and ductilities than similarly processed plain low-carbon killed or rimmed steels containing no titanium. The processing there described is limited to that of titanium-bearing steels wherein the effective titanium to carbon ratios are greater than 4 to 1; a ratio based on the amount of titanium in excess of the amount necessary to combine with all the sulphur, nitrogen and oxygen and is present either combined with carbon or in an uncombined state. Of the steels there disclosed, the greatest tensile strength is 116.7 ksi.

OBJECTS AND SUMMARY OF THE INVENTION

It is an object of this invention to provide a titanium bearing steel having high yield strength and good formability characteristics and a process for producing such steel. It is a further object of this invention to provide a process whereby a steel having preselected aim yield strength may be produced.

Briefly, the objects are attained by cold reducing in the order of 40 to 90% steel strips of the designated compositions and thereafter annealing the cold-reduced steel at preselected times and temperatures which will provide yield strengths of at least 120 ksi and an excellent ductility characteristic, as measured by percent elongation, preferably in the order of 4 to 12 percent; the degree of cold reduction is preselected to provide an as-rolled yield strength of at least 125 ksi.

We have discovered that certain titanium additions as alloying agents provide unique and advantageous annealing controls as compared to the use of other agents such as columbium, zirconium, or vanadium. Previously, a useful low carbon high strength low alloy cold rolled steel product, having a yield strength of at least 120 ksi, was impractical and unattainable. Conventional plain-carbon cold rolled steels are incapable of being processed to the high strength levels of this invention, without heating above the $A_1$ or austenitic transformation temperature range. Other high-strength, low-alloy, low-carbon systems using other alloying agents do not possess the annealing characteristic of this invention which provides practical process and physical properties controls, nor do the steels of such other systems exhibit the inclusion control which contributes to excellent bendability in steels having yield strengths of at least 120 ksi.

Figure 1:
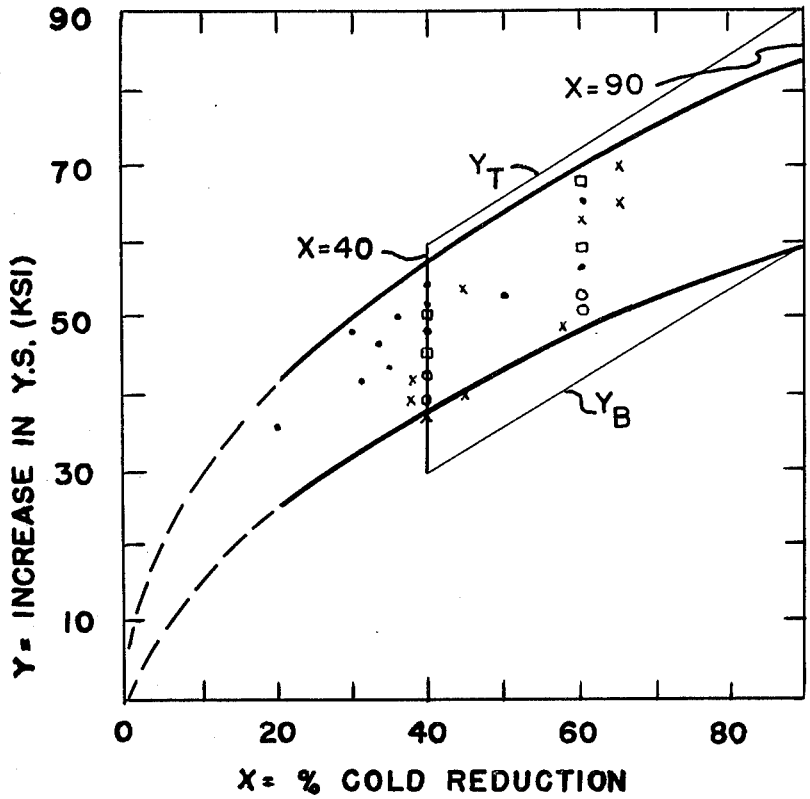
FIG. 1 is a diagrammatic representation of the increases in yield strength (Y.S.) for four different steel compositions tested by cold reducing hot rolled material at various percentages (%) of cold reduction.

In each of Figs. where the yield strength (Y.S.) is shown, unless otherwise indicated, it is for the longitudinal yield strength.

DESCRIPTION OF THE INVENTION

The following examples in Table I disclose the ranges and the preferred percentages, by weight, of the principal elements of the embodiments of compositions from which low carbon, low alloy, high strength steel of this invention may be prepared. For convenience of description, the compositions preferred for producing steels having a yield strength of at least 120 ksi but less than 140 ksi are designated as Ti-120 and the compositions preferred for producing steels having a yield strength of at least 140 ksi are designated as Ti-140.

Table I

| Element | Broad Range | Ti-120 Typical Range | Ti-120 Preferred Aim | Ti-140 Typical Range | Ti-140 Preferred Aim |
|---|---|---|---|---|---|
| Carbon | .04 - .15 | .05 - .08 | .06 | .06 - .10 | .07 |
| Manganese | .20 - 1.50 | .40 - .60 | .45 | .75 - 1.00 | .90 |
| Phosphorus | .001 - .080 | (1) | (1) | (1) | .007 |
| Sulphur | .010 - .040 | (1) | (1) | (1) | .02 |
| Aluminum (deoxidizer) | .010 - .120 | (2) | .04 - .05 | (2) | .04 - .05 |
| Nitrogen | (1) - .01 | .004 - .007 | (1) | .004 - .007 | (1) |
| Silicon | .005 - .30 | (1) | .01 | (1) | .01 |
| Titanium | | | | | |
| Total | .10 - .32 | .16 - .22 | .18 | .19 - .28 | .22 |
| Soluble | .02 - .20 | .06 - .12 | .10 | .08 - .14 | .13 |

(1) residual
(2) sufficient to kill

The range of total titanium to carbon ratio will not generally exceed 6/1; however, the aim ratio is 3/1 to 4/1 for optimizing strength. The range of soluble titanium to carbon ratio generally obtained is in the order of 1/2 to 3/1.

The steel of this invention may be made by processing the above identified compositions using basic oxygen furnace or open hearth technology, to a slab condition via ingot or strand casting, hot-rolling the slab under controlled conditions to form a hot band, cold reducing the hot band by a preselected percentage, and annealing the cold reduced strip at a preselected time-temperature relationship or annealing parameter M. The parameter $M = T(C + \text{Log}_{10}t) \times 10^{-3}$ is derived from a rate equation for diffusion; see Larson and Salimas, "A Time-Temperature Relation for Recrystallization and Grain Growth", Transactions of the American Society for Metals, vol. 46, p. 1377. $T$ = temperature in degrees Kelvin and $t$ = time in seconds. The letter "C" is a constant and for the steel material has been established to have a value of 20. A preferred method of this invention embodies annealing temperatures and times which produce an annealing response parameter of 17.8 - 22.5 for reasons which will be hereinafter described and become apparent.

Table II

| AIM Y.S. Range - ksi | Prin. Ingreds. % Wt. C | Mn | Ti | Total Ti to C Ratio | Hot Mill Aims Temp. ° F F in | Coil. | YS ksi | % C.R. | Anneal ° F/ Hr. (M) | Mechanical Properties Long. (1) Y.S. ksi | Long. *% El | Trans. (1) Y.S. ksi | Trans. *% El. |
|---|---|---|---|---|---|---|---|---|---|---|---|---|---|
| 120 - 129 | .06 | .45 | .16 | 2.6 | 1650 | 1250 | 70 - 85 | 50 | 900/24 (18.8) | 125 | 7.0 | 134 | 5.0 |
| 130 - 139 | .06 | .45 | .18 | 3.0 | 1600 | 1150 | 80 - 95 | 50 | 900/24 (18.8) | 135 | 7.0 | 151 | 4.0 |
| 140 - 149 | .06 | .70 | .22 | 3.6 | 1600 | 1150 | 85 - 105 | 50 | 900/24 (18.8) | 145 | 6.0 | 160 | 4.0 |
| 150 - 159 | .06 | .70 | .22 | 3.6 | 1625 | 1120 | 90 - 110 | 50 | 875/24 (18.4) | 155 | 6.0 | 170 | 3.0 |
| 160 - 169 | .06 | .90 | .22 | 3.6 | 1650 | 1120 | 95+ | 55 | 875/24 (18.4) | 165 | 5.0 | 176 | 2.5 |
| 170 - 179 | .07 | .90 | .24 | 3.4 | 1650 | 1100 | 95+ | | 875/24 (18.4) | 175 | 4.0 | 185 | 2.0 |
| 180+ | .07 | 1.00 | .24 | 3.4 | 1650 | 1075 | 95+ | 60 | 875/24 (18.4) | 183 | 3.0 | 192 | 1.5 |

*% Tensile Elongation in 2 inches
(1) The tensile strength will generally exceed the yield strength by 8 to 2 ksi as the yield strength varies from 120 to 180 ksi, respectively.

A typical procedure for practicing the present invention will now be disclosed in conjunction with Table II wherein the preferred aim values are shown.

The first step is to select the desired end product yield strength level, i.e. the Y.S. value after cold reduction and annealing, and the chemistry composition which will provide such strength level. The optimum aim total titanium to carbon ratio is in the order of 3.6 and will generally range from 3/1 to 4/1; however, at the lower strength levels where optimum strengthening is not required, e.g. in the 120–129 Y.S. range, the ratio can be reduced. We have observed in our work that for total Ti to C ratios less than 3.2, for each reduction in the ratio of 1.0 there generally occurred a reduction in the hot roll yield strength of about 25 ksi.

The next step is to select a hot band product which will provide the necessary yield strength after being subjected to preselected and controlled finishing and coiling temperatures. The control of the finishing and coiling temperatures will determine the amounts of soluble Ti (and the soluble Ti to C ratio) which will be produced and which affects the dispersion of the Ti precipitates and the strengthening characteristics of the steel.

Another factor which must be taken into account in selecting the hot band material is the thickness of the starting hot band material as compared with the desired thickness of the end product for this will determine the percent of cold roll reduction. The degree of cold reduction will in turn affect the gain in yield strength and the total strength of the as-rolled product. Hence, the yield strength of the as-rolled product $YS_{AR}$ may be expressed as:

$$YS_{AR} = YS_{HB} + YS_{Rolling\ gain};$$

where $YS_{HB}$, the hot band yield strength is a function of chemistry and hot rolling processing conditions, i.e., gage, width, and finish and coiling temperatures;

and $YS_{Rolling\ gain}$ is a function of the cold reduction.

The selection of the $YS_{AR}$ is determined by the final yield strength $YS_{AA}$ (as annealed) desired. A $YS_{AR}$ must be selected which will provide the desired $YS_{AA}$ when processed in accordance with the temperature-time parameter M. In accordance with this invention the value of the parameter M will be in the range of 17.8 to 22.5.

The slabs are solution heat treated at a temperature above 2000° F, preferably above 2200° F, and are then control rolled at a hot rolling finishing temperature greater than 1500° F, and preferably greater than 1550° F. The cooling of the strip may be controlled, in a manner as set forth in U.S. Pat. No. 3,625,780 to Bosch et al, to provide a coiling temperature below 1250° F. Hot band yield strength levels generally between 70 and 110 ksi are produced. The specific range of hot band yield strength levels is dependent upon the composition used. The Ti-120 composition will generally produce hot band yield strengths in the 70 to 95 ksi range while the Ti-140 composition will generally produce hot band yield strengths in the 85 to 110 ksi range. The hot band strength levels attained by the compositions of this invention are believed to be attributable to an interphase precipitation of titanium carbonitrides (TiCN), and grain refinement. The processing of the compositions of this invention which produce hot band strength levels in the range of 70 to 110 ksi if applied to a plan, low-carbon aluminum killed steel will only produce hot band yield strength levels in the general range of 28 to 48 ksi.

After pickling, the hot band is cold rolled to reduce it to the approximate desired final thickness. Various relationships between the percent of cold reduction and the resultant gain in as-rolled yield strength (i.e., before annealing) for the steels of this invention, designated by *x*, and for other steels have been developed and are graphically illustrated in FIG. 1.

Exemplary compositions of steels for which such relationships are there illustrated include as principle ingredients the following, with the remainder being essentially iron and residual impurities, in percent by weight:

| | Designation | C | Mn | Al | Ti | V | Cb |
|---|---|---|---|---|---|---|---|
| I | x | 0.08 | 0.52 | 0.020 | 0.24 | | |
| II | □ | 0.16 | 1.30 | 0.052 | | 0.10 | |
| III | ○ | 0.09 | 1.54 | 0.029 | | 0.09 | 0.11 |
| IV | • | 0.04 | 0.29 | 0.032 | 0.01 | 0.01 | 0.01 |

The area which is of particular concern of this invention may be observed in FIG. 1 and is that represented between 40 and 90 percent reductions and which generally provide 30 to 90 ksi increases in yield strengths. This area may be described as being defined by the equations: (1) $X = 40$; (2) $X = 90$; (3) $Y_B = .6X + 6$; and (4) $Y_T = .6X + 36$, where $Y_B$ and $Y_T$ represent the yield strengths of the bottom and top lines, respectively, and 0.6 is the slope of the lines.

Figure 2:
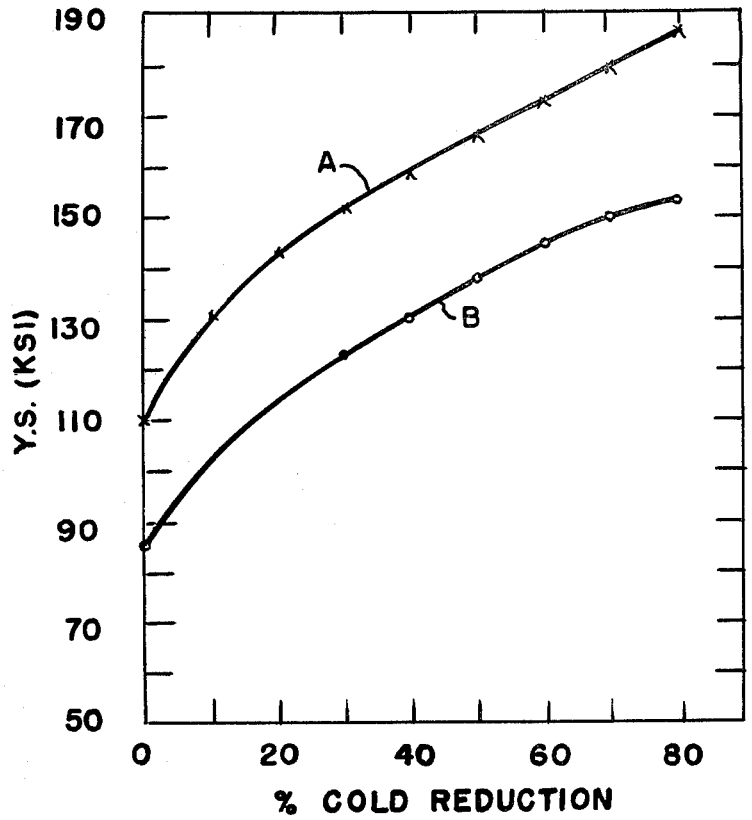
FIG. 2 is a diagrammatic representation of the cold rolled yield strength to % cold reduction from hot band for two different compositions of this invention.

In FIG. 2 there is shown the effects of cold reduction for two different steel compositions of this invention; composition "A" containing 0.27% Ti, 0.09% C and having an as hot rolled yield strength of about 110 ksi; composition "B" containing 0.19% Ti, 0.06% C and having an as hot rolled yield strength of about 85 ksi.

It will be noted that the correspondence of the resultant yield strength after cold rolling at the various percentages of reduction with the expected yield strengths, in accordance with the results shown in FIG. 1 are very close. For example, with composition "A" having an as hot rolled yield strength of 110 ksi, with a 40% reduction, one would expect to obtain a yield strength after cold rolling in the order of 140 to 170 ksi; the yield strength obtained from the sample tested is about 158 ksi. Similarly, with composition "B" having an as hot rolled yield strength of 85 ksi, with a 40% reduction, one would expect to obtain a yield strength after cold rolling in the order of 115 to 145 ksi; the yield strength obtained from the sample tested is 130 ksi. At 70% reduction, a sample of composition "A" produced 180 ksi yield strength, as compared to an expected yield strength of 158 to 188 ksi, and a sample of composition "B" produced 150 ksi yield strength, as compared to an expected yield strength of 133 to 163 ksi.

It will also be observed in FIG. 2 that generally the same as-rolled yield strength may be obtained from different compositions; for example, composition "A" with a 23% cold reduction will provide a yield strength of about 145 ksi which can also be provided from composition "B" with a 60% reduction.

In order to increase the ductility of the cold rolled steel so that it will be suitable for commercial forming operations, it must be subject to annealing heat treatment. The term "annealing" is generally applied to treatments which relieve stresses and soften the steels. Process annealing of cold worked steels causes changes in the physical and mechanical properties which approach the characteristics of the material prior to working.

The processes that occur with such treatment are of three distinguishable types: recovery, recrystallization and grain growth.

Recovery is defined as a change in properties, particularly those caused by changes in internal strain of the cold worked metal without any significant change in the microstructure.

Recrystallization is the development of an entirely new grain structure.

Grain growth after recrystallization is the continued growth of the recrystallized grain.

The amount of cold reduction, the annealing temperature, the annealing time, and the original grain size are all factors which influence the strength and formability of the steel being processed.

Figure 3:
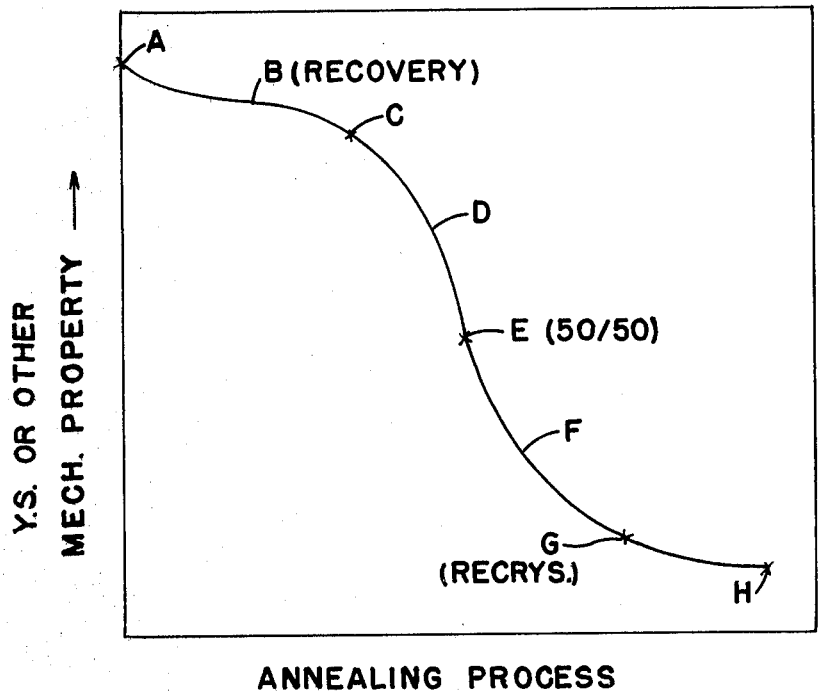
FIG. 3 is a diagrammatic representation of the various stages of the annealing process and the effect on the mechanical properties of steel.

The annealing processes may be described as comprising eight separate stages shown in FIG. 3, which are dependent upon a time-temperature factor:

1. As-rolled metal — metal cold reduced beyond a critical value, which is generally accepted as being about 15% for low carbon steels. (Point "A" in FIG. 3.)

2. Recovery anneal — one where no appreciable change in microstructure has occurred; no recrystallization; region designated as "B" (area between points A and C) where the slope $|dy/dx|$ of the curve is relatively low where Y is a mechanical property such as yield strength, hardness, etc., and X is the time-temperature parameter.

3. Initiation of Recrystallization — point "C" where strainfree grains first appear; new grains grow at expense of deformed recovered microstructure; the value of slope $|dy/dx|$ starts to increase.

4. Partial recrystallization Phase I — region "D" (area between points C and E) where the rate of nucleation and growth of strainfree grains increase; the microstructure may consist of 0 - 50% recrystallized grains; however, the recovery structure predominates.

5. 50% Recovery/50% Recrystallization — point "E" where the recrystallization process proceeds at maximum rate with a maximum release of stored energy; the slope $|dy/dx|$ is at its maximum.

6. Partial recrystallization Phase II — region "F" (area between points D and G) where the recrystallization process decelerates, thus the value of slope $|dy/dx|$ decreases; the recrystallized structure is dominant over the recovered structure, i.e., recrystallized structure is greater than 50%.

7. Fully recrystallized — region "G" on the curve; 100% strain-free grain; an anneal which produces this structure is considered to be a recrystallization anneal; the value of slope $|dy/dx|$ decreases.

8. Grain growth — continued growth of recrystallized grains; region "H" (area beyond point G) where the value of slope $|dy/dx|$ of curve is substantially constant.

Figure 4:
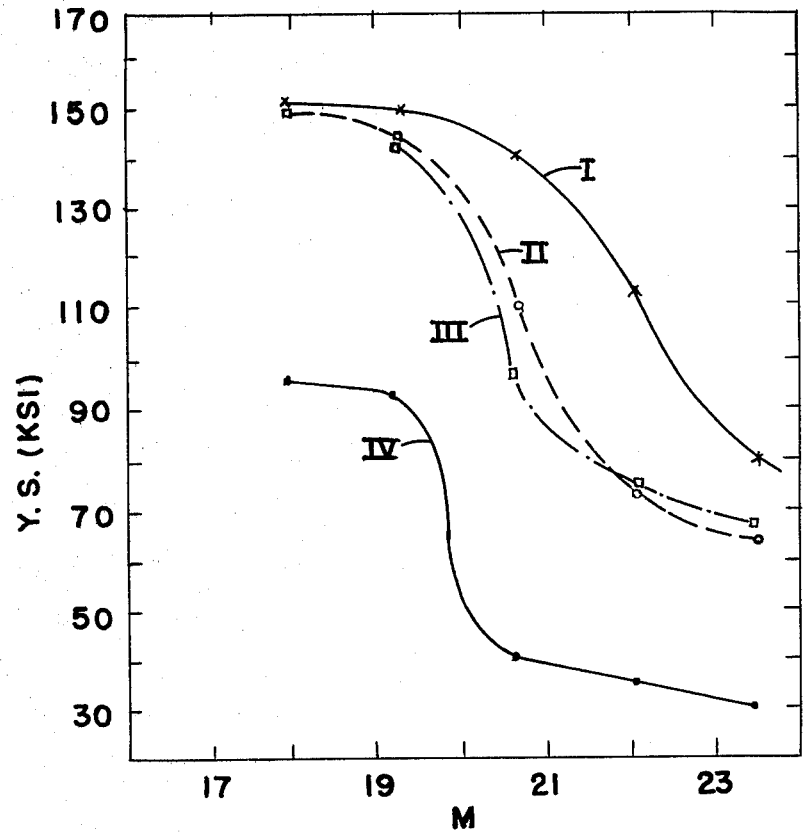
FIG. 4 is a diagrammatic representation of the effect of annealing parameter M on the yield strength of cold reduced steels.

In FIG. 4 is illustrated the time-temperature parameter M versus yield strength developed for the four steel compositions I - IV. The annealing processing of the various steels can be compared and it will be observed that titanium bearing compositions of this invention (I) react sluggishly, as compared to the other compositions, in respect to the time-temperature parameter. The yield strength characteristics of these compositions are disclosed in Table III.

Table III

| | Yield Strength ksi | | | | | M = 18.0 to 21.5 | |
|---|---|---|---|---|---|---|---|
| | As | As | Annealed/16 hr | | | Ave. | Ave. % |
| Steel | Hot Rolled | Cold Rolled | 850° F M = 18.0 | 950° F M = 19.4 | 1100° F M = 21.5 | Loss Y.S. ksi | Change Y.S. per M Unit |
| I | 96.7 | 157 | 152 | 148 | 128 | −24 | −5 |
| II | 89.5 | 152 | 146 | 142 | 94 | −52 | −10 |
| III | 88.1 | 157 | 153 | 146 | 83 | −70 | −13 |
| IV | 41.1 | 108 | 96 | 93 | 37 | −59 | −18 |

Samples of the steel compositions were prepared and hot rolled; each steel was cold reduced 60% (± 3%) to thickness between 0.035 and 0.045 inch; and samples of each were batch annealed simultaneously for 16 hour cycles (simulations of practical annealing cycles) at temperatures of 850° F, 950° F, 1050° F, 1150° F and 1250° F (all ± 15° F). It will be noted that the cold rolled yield strength of each sample increased by about 62 ksi (± 6) over the hot rolled yield strength; those samples which displayed cold rolled yield strengths in the 150 - 160 ksi range reacted similarly to annealing in the 850° - 950° F range for 16 hours (M = 18.0 to 19.4); however, at temperatures above 950° F, or where M ≧ 19.4, the yield strengths of all the steels, except the Ti bearing ones, decreased significantly. It will be further noted that with annealing temperatures of 950° to 1100° F (M = 19.4 to 21.5), the Ti bearing steels were the only ones where the yield strengths decreased at sufficiently slow rates that at least 75% of their as-rolled yield strength values were retained and that the average rate of yield strength value loss for the steels of this invention, i.e., where M = 17.8 to 22.5, is only about 5%/M unit, whereas the other steels display yield strength losses ≧ 10%/M unit.

The sluggish response of the steel compositions of this invention to the annealing processes of recovery and partial recrystallization has been used advantageously in providing effective controls towards the consistent and repetitive production of high strength low alloy titanium bearing steels which display high strengths and excellent bendability characteristics.

Figure 5:
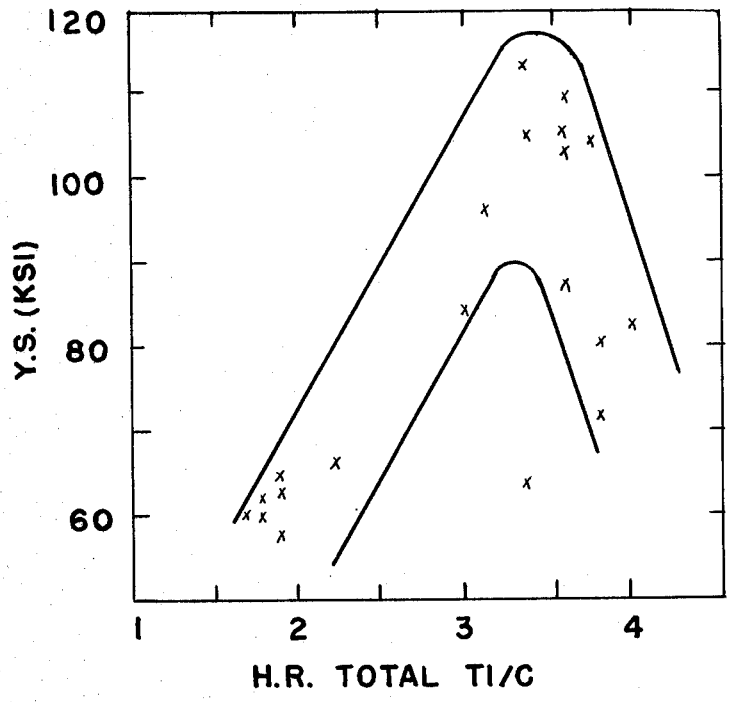
FIG. 5 is a diagrammatic representation of the total titanium (Ti) to carbon (C) ratios found to exist at various yield strength levels of steel compositions of this invention in the hot rolled (HR) condition.
Figure 6:
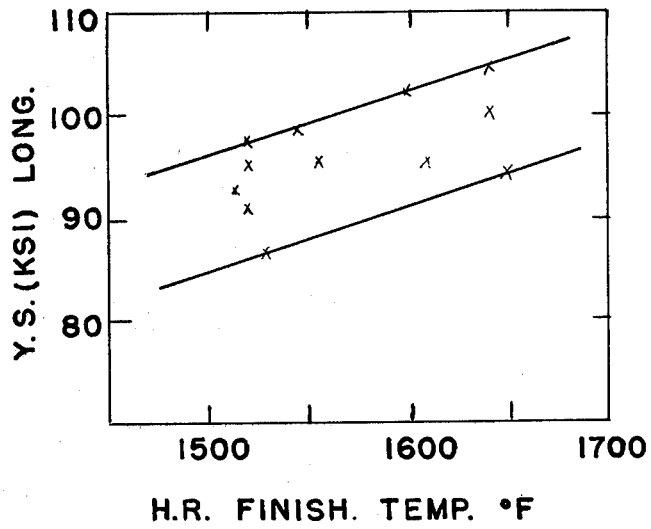
FIG. 6 is a diagrammatic representation of the longitudinal (long.) strength levels corresponding to various hot roll finishing temperatures (temp.) ° F for a steel composition corresponding to that designated as Ti-140 and for coiling temperatures in the range of 1075° – 1175° F.
Figure 7:
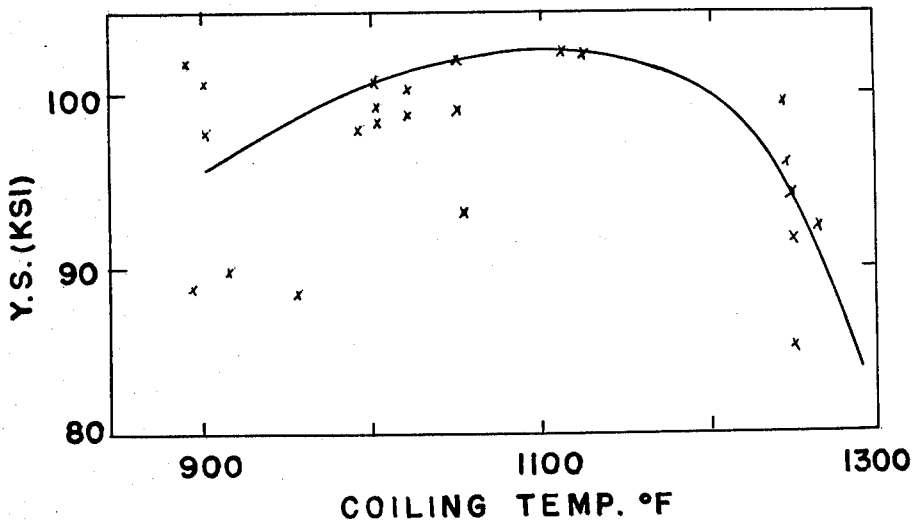
FIG. 7 is a diagrammatic representation of the coiling temperatures ° F and corresponding yield strength levels illustrating that the optimum coiling is in the general range of 1075° to 1175° F for strip hot-finished at temperatures in the 1600° – 1650° F range.
Figure 8:
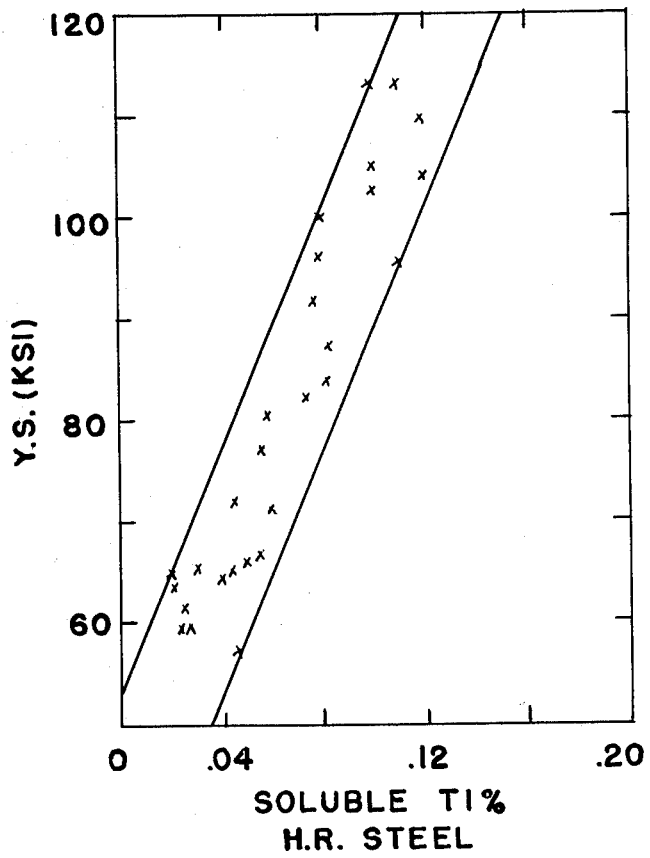
FIG. 8 is a graphic representation of the % levels of soluble titanium (Ti) found to exist at various yield strengths of hot rolled steels of this invention.

The tests and processing that we have conducted indicate that compositions having a carbon content within the range of 0.04 to 0.15%, by weight, and which are similarly processed, will develop maximum hot roll yield strengths when the total Ti to carbon ratio is in the order of 3/1 to 4/1. See FIG. 5. The data developed also indicates that the highest strength values will be developed when the soluble Ti and the soluble Ti to C ratio are maximized; these maximums can be attained by selectively and suitably adjusting the finishing temperatures and the coiling temperatures. See FIGS. 6 and 7, respectively. FIG. 8 discloses that the hot roll yield strength increases as a function of soluble titanium. In the tests from which the data for FIG. 8 was compiled, the total Ti was was substantially the same, therefore, as the percent of soluble Ti increased, the ratio of soluble Ti to total Ti also increased. If the chemistry and the hot-mill processing parameters are optimized toward strengthening, the hot rolled yield strengths will increase as a function of the soluble Ti and the soluble Ti to C ratio to a maximum yield strength of 115 ksi at an average value of 0.11% soluble Ti.

The following Table IV illustrates the effect of various cold-reduction on hot band material of the same chemical composition and which has been subjected to the same heating parameter M. The hot band consisted of, % by weight, 0.06 C, 0.82 Mn, 0.055 Al, and 0.22 Ti(with 0.11% being soluble Ti) and the remainder essentially iron. There it is demonstrated that higher reductions usually result in higher yield strengths; that with lower reduction the compositions respond more sluggishly; and that higher percentages of soluble Ti are associated with the higher strength values indicating the effect of precipitation strengthening by fine dispersions of Ti precipitates.

Table IV

| Anneal | | Reduction | | | | | | |
|---|---|---|---|---|---|---|---|---|
| | | 45% | | 60% | | 80% | | |
| Cycles ° F | M Values | Y.S. (ksi) | % El. | Y.S. (ksi) | % El. | Y.S. (ksi) | % El. | Sol. Ti. |
| Hot Band (As H.R.) | — | 112.3 | 19.5 | 112.3 | 19.5 | 112.3 | 19.5 | .11 |
| As Cold Rolled | — | 165.2 | 2.5 | 182.6 | 2.0 | 192.2 | 1.5 | .11 |
| 840° | 17.9 | 157.6 | 4.0 | 174.0 | 2.5 | — | 1.5 | .10 |
| 940° | 19.2 | 158.5 | 4.0 | 171.9 | 2.5 | 176.8 | 1.0 | .10 |
| 1080° | 21.2 | 151.4 | 6.5 | 154.9 | 3.0 | 152.9 | 3.0 | .08 |
| 1150° | 22.1 | 135.7 | 11.0 | 120.5 | 11.0 | 110.1 | 12.5 | .04 |
| 1260° | 23.7 | 77.1 | 19.5 | 81.4 | 21.0 | 83.6 | 21.0 | .01 |
| 1350° | 24.9 | 67.8 | 19.0 | 71.2 | 21.0 | 68.9 | 19.0 | .01 |

It is believed that the presence of Ti in a low carbon steel results in a transformation of austenite to ferrite which includes the precipitation of a fine dispersion of Ti precipitates in sheet form, which sheets are generally parallel to the $\gamma$-$\alpha$ phase boundary.

The solubility of TiC is generally considered to be about 0.23 atomic % at 2280° F and to continuously reduce with temperature to about 0.08 atomic % at about 1830° F. The presence of TiC which exceeds the solubility can result in precipitates in the austenite and affect the grain size. On transformation, isothermally at temperatures generally in the range of 1100° - 1560° F, or through controlled continuous cooling through the phase change:

(1) the pearlite reaction ($Fe_3C$) is suppressed because the carbon preferentially combines with Ti;

(2) a fine dispersion of TiC is produced in the ferrite; lower isothermal transformation temperatures and faster continuous cooling rates usually produce finer distributions (interphase precipitation); and (3) the coarsening of or aging process of the precipitates is resistant and sluggish, partly because of the relatively low solubility of TiC in austenite.

It is also believed that as the temperature at which transformation occurs is lowered, the precipitates are smaller, closer together, the precipitate sheets are closer together, and that there is an attendant increase in yield strength.

Precipitate size and its effect in strengthening have been investigated by electron and field ion microscopy and indications are that the smaller precipitate particle sizes contribute most efficiently towards strengthening.

In respect to particle shape, it has been found that particles less than 20 A° in size are primarily spheroidal, those less 60 A° are spheroidal, plate-like, or an intermediate shape, those above 200 A° are of various shapes. The particles are considered to be coherent with the matrix with lattice strain present at the early stages of growth (20° - 30 A°). The higher yield strengths, 90 ksi and higher, are generally associated with this particle size. There occurs a loss of coherency, although some lattice strain is present, with particle growth above 30 A°. These particle sizes, 30° - 200 A°, are generally associated with medium to high yield strengths and considered to be semi-coherent in respect to the particle/matrix interface. Particles of at least 200 A° pass through the phase sequence of coherent to semi-coherent to non-coherent. A non-coherent TiC particle is one which has assumed a face-center-cubic structure in a body-center-cubic ferrite matrix with a mismatch of the crystalline structures at the particle/matrix interface.

Precipitation strengthening and high yield stresses are primarily obtained through the effect of the high lattice strains of the precipitate particles on the dislocation mobility. The coherent and semi-coherent particles participate in the precipitate strengthening and the larger non-coherent particles aid in grain refinement.

A test has been developed to determine that portion of the total Ti in a low carbon-killed steel which contributes to precipitation strengthening. The test provides an indication of the quantity of Ti which appears as part of TiC particles in coherent or semi-coherent form. The test comprises: dissolving a sample of the steel in a warm 1 part $H_2O$/1 part HCl acid solution; filtering off the insoluble contents; and completing the analysis by determining the acid-soluble Ti through atomic absorption spectroscopy.

Figure 11:
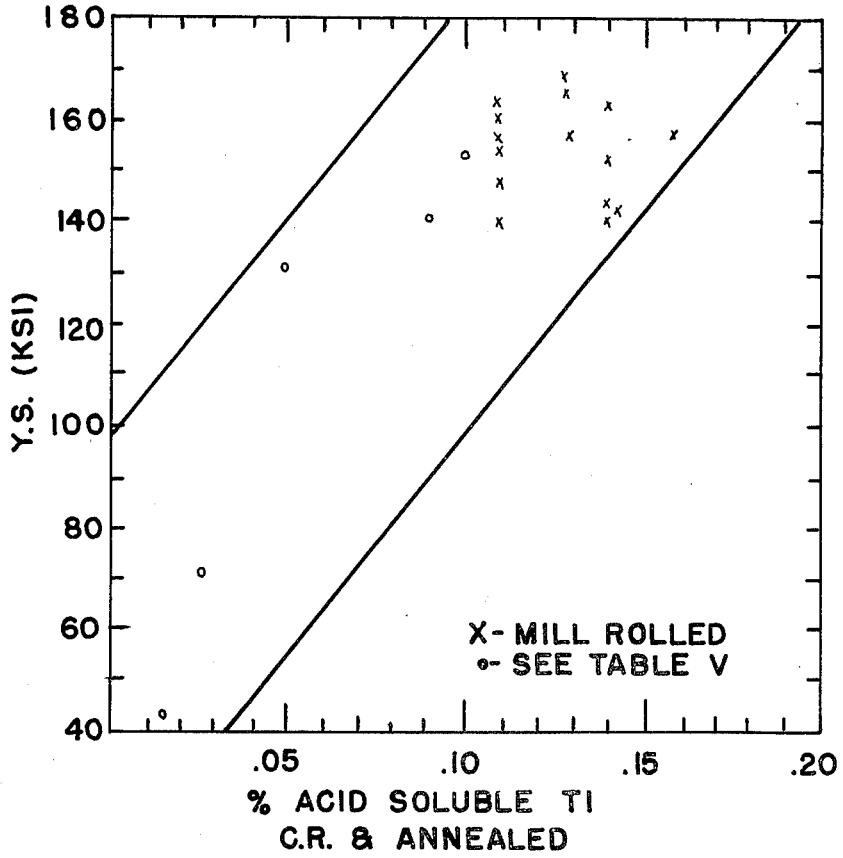
FIG. 11 is a graphic representation of the % levels of the acid soluble Ti in the cold rolled and annealed steels of this invention.

The relationship between soluble Ti and as-hot rolled sheet yield strength is graphically shown in FIG. 8, and that between soluble Ti and the cold rolled and annealed material is shown in FIG. 11.

The insoluble Ti will generally be in one or more of the following particle forms: crystalline TiN (formed in the melt); $Ti_4C_2S_2$; and TiC (non-coherent), all of these particles being above 200 A° in size. Each of TiN and TiC compounds usually include minute amounts of C and N, respectively.

Table V is a compilation of test data illustrating the correlation between yield strength (as cold rolled and annealed) and soluble Ti. Table V also serves to point out the distinction between soluble Ti and effective Ti (Eff. Ti), where Eff. Ti is defined by the formula Eff. Ti = Total Ti − 3.4 (N) − 1.5 (S) given in U.S. Pat. No. 3,857,740. The soluble Ti data is also plotted versus the longitudinal yield strength in FIG. 11. The effective Ti to C ratio is about, 3.2/1, however, in all of our tests the ratios were found to be generally in the range of 2.5/1 to 3.8/1.

Table V

| Temp °F (M) | hrs. | Y.S. ksi (L) (T) | % El. | Chemistry Wt. % C | Mn | S | O | N Tot. | N Sol. | Al | Ti Tot. | Ti Sol. | Ti Eff. |
|---|---|---|---|---|---|---|---|---|---|---|---|---|---|
| 900 (18.8) | 20 | 152 169 | 8 3 | .06 | .89 | .017 | .0035 | .0074 | .0038 | .043 | .25 | .100 | .194 |
| 1000 (20.1) | 16 | 141 162 | 8 5 | .06 | .89 | .016 | .0046 | .0071 | .0029 | .041 | .25 | .089 | .195 |
| 1100 (21.5) | 16 | 133 151 | 9 5 | .06 | .89 | .017 | .0046 | .0068 | .0028 | .041 | .25 | .050 | .195 |
| 1200 (22.8) | 16 | 71 82 | 13 10 | .06 | .89 | .017 | .0062 | .0069 | .0028 | .043 | .25 | .025 | .192 |
| 1250 (23.5) | 16 | 43 48 | 22 21 | .06 | .89 | .016 | .0082 | .0070 | .0030 | .043 | .25 | .015 | .190 |

It is within the contemplation of this invention to provide a Ti bearing low alloy steel which is primarily recovery-annealed, i.e., one in which the microstructure is not more than 50% recrystallized, as opposed to a steel which is primarily recrystallized annealed, i.e. one in which the microstructure is more than 50% recrystallized.

In U.S. Pat. No. 3,857,740 there is described a Ti bearing steel processed through recrystallization annealing and it is stated that it is impossible to produce the desired high strength of that invention unless the recrystallization annealing temperature is higher than the coiling temperature. The present invention does not contemplate recrystallization annealing as that described in U.S. Pat. No. 3,857,740, nor is it necessary that the annealing temperatures in the processing of this invention necessarily be higher than the coiling temperature; in most cases the annealing temperatures will be lower than the coiling temperatures, particularly if batch annealing is employed. Furthermore, much higher yield strengths after annealing are obtainable, with attendant higher percentages of elongation, with the processing of this invention than those disclosed in U.S. Pat. No. 3,857,740.

The present invention contemplates annealing which can extend through stage 5 described above and as is generally schematically depicted in FIG. 3 as the stage where the slope of the annealing curve $|dy/dx|$ is at a maximum, which corresponds to a microstructure wherein there exists the maximum release of stored energy and also generally corresponds to an annealing parameter M of up to about 22.5. However, from the standpoint of obtaining optimum strengths with ease of processing control, it is preferred to process within a processing parameter whereby a microstructure is produced which is predominantly recovered with little partial recrystallization and most preferably within a parameter whereby the resultant microstructure does not extend beyond the stage where recrystallization is initiated. In the preferred stages, the slope of the curve $|dy/dx|$ is sufficiently gradual that a small deviation from the aim M parameter will not produce as pronounced a variation from the aim yield strengths as will be produced at a point on the curve where the slope is more drastically changing, i.e., $|dy/dx|$ is much greater.

Figure 9:
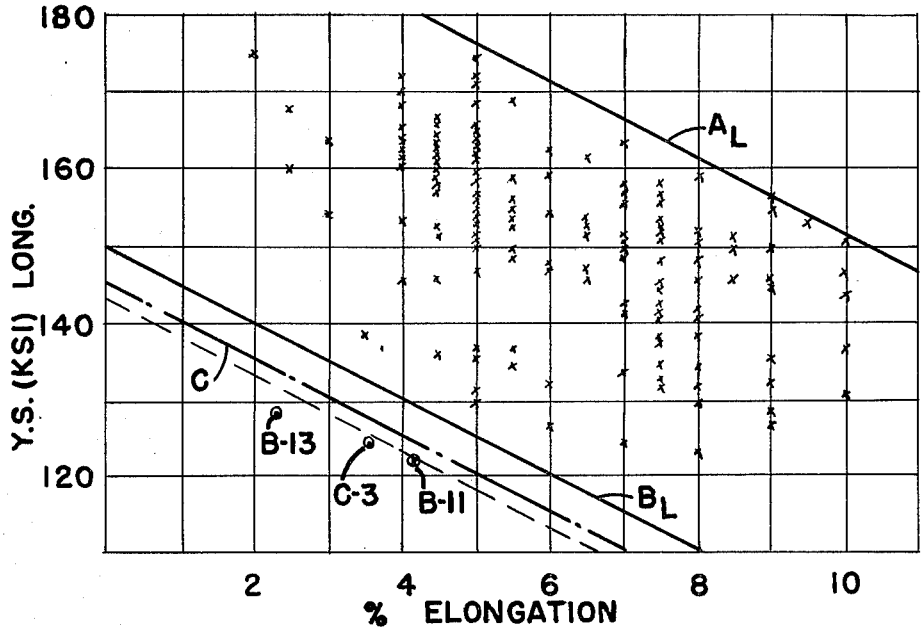
FIG. 9 is a graphic representation of the longitudinal (long.) yield strength versus % elongation relationship after annealing in accordance with this invention, included are three points of a steel processed in accordance with another process.
Figure 10:
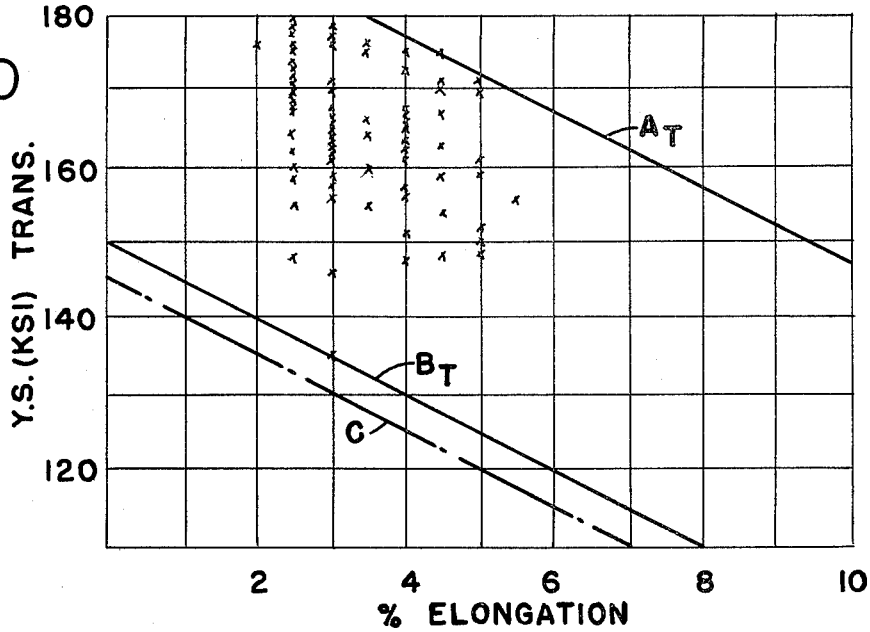
FIG. 10 is a graphic representation similar to FIG. 9 but of the transverse yield strength versus % elongation.

In FIG. 9 there is plotted the results of material tested for a comparison of the longitudinal yield strengths with their corresponding percents of elongation. The results include a showing of the trend of the percent of elongation to increase with a reduction in the yield strength within the band of results delineated by upper line $A_L$ and lower line $B_L$, which lines slope in a negative direction. A similar trend is demonstrated in the results of the transverse yield strength vs. percent elongation shown in FIG. 10. What is significant, however, is the elongation which is attainable by the processing of this invention. It will be noted that all of the elongation values extend through or are above a line (line $B_L$ in FIG. 9 and line $B_T$ in FIG. 10) which can be defined by the equation:

$$\text{Yield strength (ksi)} = -5 \text{ elongation } (\%) + 150.$$

In other words, the yield strength (long.) to percent elongation relationship is one where the yield strength is at least 150 ksi minus five times the percent of elongation. It will be noted in FIG. 9, at a 135 ksi yield strength level, transverse or longitudinal, one can expect to attain a 3% or better elongation value. The significance can be further illustrated by a comparison of the yield strengths and corresponding elongations attained by the processing disclosed in U.S. Pat. No. 3,857,740 to Gondo, et al. There are disclosed only three examples of compositions whereby yield strengths of at least 120 ksi were attained; these were grades B-11, B-13, and C-3.

| Grade | Y.P. Kg/mm² | Y.P. ksi | El. % | El.* % |
|---|---|---|---|---|
| B-11 | 87.6 | 123 | 4.2 | 5.4 |
| B-13 | 91.6 | 128 | 2.3 | 4.4 |
| C-3 | 88.4 | 124 | 3.6 | 5.2 |

*Minimum which can be expected by present invention

While the minimum elongations expected by the present invention are shown in the above table, it will be observed in FIG. 9 that the majority of the longitudinal elongations are typically within the range of 5 - 10%.

It will be observed that all of Gondo et al, elongation values described above would fall below the phantom line C defined by the equation:

$$\text{Yield strength (ksi)} = -5 \text{ elongation } (\%) + 145$$

whereas all of the elongation values of the present invention extend through or above the line C.

It is recognized that different areas of the same strip or coil of steel will heat or reach the aim temperature at different temperature-time rates. The difference between the coldest areas and the hottest areas is usually more pronounced in batch annealing than in continuous strip annealing.

In batch annealing, the thermocouple which controls the heating cycle is usually positioned to sense a heat condition intermediate of the two extremes of the coldest and hottest areas. Among the factors which can influence the degree of difference between such extremes are: the number of coils; the size of coils, including variations in size of coils in the same batch; position of coil in stack or furnace; furnace and burner firing rates; type of heating, direct or indirect firing; circulating gas flow rates; soak times; etc. We have observed that the variation in the temperature-time parameter M for the coldest area as compared with the hot spot can be as high as 1.2. Accordingly, if it is desired to process coils with a reasonable assurance that the coldest spot is exposed to a heating parameter M of at least 18, the aim parameter should be 18.6.

In continuous annealing, the variation in M is generally in the range of 0.4 to 0.8. Some of the factors which affect the control of and variation in the anneal parameter M are: strip thickness variation, emissivity variation; strip shape, including amount of crowning; strip width (edge annealing greater with narrower strips); and variations in furnace temperature zones.

The significance of the discovery and recognition of the degree of difference between the cold and hot spot of a coil is that a proper adjustment of the aim M parameter in the annealing processing will provide improved minimum and uniformity of ductility and strength in the high strength products of this invention.

An example of the application of such adjustment was made in the processing of material which was to have an aim yield strength range of 140 - 160 ksi. Originally, the material was processed through a batch annealing cycle of 850° F for 20 hours, an average M parameter of 18.1; however, such processing resulted in the coldest portion of the batch being exposed approximately to a minimum heating cycle of 800° F for 14 hours, a M parameter of about 17.3. The result was that the material tested out to have a relatively wide spread of yield strengths within an overall range of 140 - 165 ksi, i.e., much of the material had a yield strength which was near the 165 ksi limit and other material from the same batch had a yield strength which was near the 140 ksi limit. The heating cycle for similar material was later revised to provide a minimum M of 18.0 for the coldest spot of a batch. The cycle was adjusted to 900° F for 24 hours, an average M of 18.8. The result was improved uniformity in yield strength throughout the material in the batch, i.e., the spread between the high and low values of yield strength was less than the spread of the material originally processed and all within the aim range of 140 - 160 ksi.

The present invention demonstrates that, contrary to previously held contentions, it is not necessary to provide effective Ti to C ratios greater than 4/1 in order to produce low alloy steels of high strength (U.S. Pat. No. 3,492,173), nor is it necessary to subject such Ti bearing steels to recrystallization annealing or annealing temperatures which are higher than the coiling temperatures (U.S. Pat. No. 3,857,740). The invention further demonstrates that the described ultra-high strength values may be attained without resort to the formation of a martensite microstructure.

What is claimed is:

1. A method of producing a precipitation strengthened cold rolled steel, which method comprises:
   (a) hot rolling a slab to a hot band having a finishing temperature above 1500° F;
   (b) coiling said band at a temperature below 1250° F;
   (c) cold reducing said band in the order of 40 to 90%; and developing a yield strength after rolling of at least 125 ksi; and
   (d) annealing the cold reduced steel at a temperature and for a time, temperature-time parameter M, such that will produce a fine dispersion of strengthening precipitates in a microstructure which is at least 50% of the recovery type and no greater than 50% of the recrystallized type and is sufficient for the steel to retain a yield strength of at least 120 ksi;

the composition of said steel consisting essentially of, in percent by weight: 0.04 – 0.15 C; 0.20 – 1.5 Mn; 0.10 – 0.32 total Ti; 0.02 – 0.20 soluble Ti; 0.01 – 0.12 Al; or other killing agent; 0 – 0.30 Si; and the balance being essentially iron and residual impurities, the total Ti to C ratio being at least 2/1.

2. The method as described in claim 1, wherein: the soluble Ti to C ratio is in the order of 1/2 to 3/1.

3. The method as described in claim 1, wherein: the temperature-time parameter M is in the order of 17.8 to 22.5.

4. The method as described in claim 1, wherein: the steel has a longitudinal yield strength which is at least 155 ksi minus five times the percent of elongation.

5. The method as described in claim 1, wherein: the total Ti to C ratio is in the order of 3/1 to 4/1.

6. The method as described in claim 1, wherein: said cold-reduced steel is annealed at a temperature and time whereby an end product is provided having a final yield strength which is at least 75% of the as-cold-rolled yield strength.

7. The method of producing a titanium precipitation strengthened cold rolled steel, which method comprises:

cold reducing a hot band of titanium bearing steel in the order of 40 – 90% annealing the cold reduced steel at a temperature and for a time such that the temperature-time parameter M is in the order of 17.8 to 22.5 and in a manner whereby the steel comprises a fine dispersion of strengthening precipitates in a microstructure which is at least 50% of the recovery type and no greater than 50% of the recrystallized type and produces a yield strength having a value in ksi which is at least as great as 145 minus five times the percent of elongation.

8. A cold-reduced and annealed titanium bearing low alloy steel having a fine dispersion of strengthening precipitates in a microstructure which is at least 50% of the recovery type and no greater than 50% of the recrystallized type; and a longitudinal yield strength of at least 120 ksi.

9. A steel as described in claim 8 wherein said yield strength in ksi is at least as great as a value corresponding to 145 minus five times the elongation in percent.

10. A steel as described in claim 8, wherein: said yield strength is at least 140 ksi and having a ductility characteristic, as measured by percent elongation, of at least 3%.

11. A steel as described in claim 8, wherein: said yield strength is in the order of 120 to 135; and having a ductility characteristic, as measured by percent elongation, of at least 5%.

12. A steel as described in claim 10, and having a ductility characteristic, as measured by percent elongation, of 5 to 10%.

13. A steel as described in claim 10, wherein: said yield strength is at least 160 ksi, and said ductility characteristic is at least 2.5%.

14. A cold-reduced primarily recovery annealed steel consisting essentially of, percent by weight:

0.04 – 0.15 C; 0.20 – 1.50 Mn; 0.010 – 0.12 aluminum; 0.10 – 0.32 total Ti; 0.02 – 0.20 soluble Ti; 0.005 – 0.30 Si; residual N and remainder being iron, and residual impurities, and characterized by a longitudinal yield strength in ksi, of at least as great as a value corresponding to 145 minus five times the elongation in percent; and a microstructure which is at least 50% of the recovery type and no greater than 50% of the recrystallized type.

15. A steel as described in claim 14, wherein: the total Ti to C ratio is in the order of 3/1 to 4/1.

16. A steel as described in claim 14, wherein: the soluble Ti to C ratio is in the order of 1/2 to 3/1.

17. A steel as described in claim 14, wherein: the effective Ti to C ratio is 2.5/1 to 3.8/1.

18. The method as described in claim 7, wherein: the total Ti to C ratio is in the order of 2/1 to 4.4/1 and the yield strength is at least 120 ksi.

19. A method of producing a precipitation strengthened Ti bearing cold rolled steel, which method comprises:
   (a) hot rolling a slab to a hot band having a finishing temperature above 1500° F;
   (b) control cooling and coiling said band at a temperature below 1250° F to provide a hot band having a yield strength in the order of 70 – 95 ksi;
   (c) cold reducing said band in the order of 40 to 75% to develop a yield strength after rolling of at least 125 ksi;
   (d) annealing the cold reduced steel at a temperature and for a time such that will produce: (1) a fine dispersion of strengthening precipitates in a microstructure which is at least 50% of the recovery type and no greater than 50% of the recrystallized type; (2) a ductility characteristic, as measured by percent elongation, of at least 5%;

the composition of said steel consisting essentially of, in percent by weight: 0.05 – 0.08 C; 0.40 – 0.60 Mn; up to 0.007 N, up to 0.30 Si; 0.16 – 0.22 total Ti; 0.01 – 0.12 Al, or other killing agent; and the balance being Fe and residual impurities, and wherein the total Ti to C ratio is at least 2/1.

20. A method of producing a precipitation strengthened Ti bearing cold rolled steel, which method comprises:
   (a) hot rolling a slab to a hot band having a finishing temperature above 1500° F;
   (b) control cooling and coiling said band at a temperature below 1250° F to provide a hot band having a yield strength in the order of 85 – 110 ksi;

(c) cold reducing said band in the order of 55 to 90% to develop a yield strength after rolling of at least 125 ksi;

(d) annealing the cold reduced steel at a temperature and for a time such that will produce: (1) a fine dispersion of strengthening precipitates in a microstructure which is at least 50% of the recrystallized type; (2) a ductility characteristic, as measured by percent elongation, of at least 3%;

the composition of said steel consisting essentially of, in percent by weight: 0.06 – 0.10 C; 0.75 – 1.00 Mn; up to 0.007 N, up to 0.30 Si; 0.19 – 0.28 total Ti; 0.01 – 0.12 Al, or other killing agent; and the balance being Fe and residual impurities, and wherein the total Ti to C ratio is at least 3/1.

* * * * *

UNITED STATES PATENT AND TRADEMARK OFFICE

CERTIFICATE OF CORRECTION

PATENT NO. : 4,082,576

DATED : 04/04/78

INVENTOR(S) : Lake, Peter B., et al

It is certified that error appears in the above-identified patent and that said Letters Patent are hereby corrected as shown below:

Col. 10, line 23, " = Total Ti - 3.4 (N) - 1.5 (S) given in U. S. Pat. No." should read -- = Total Ti - 3.4 (N) - 1.5 (O) - 1.5 (S) given in U. S. Pat. No. --

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*